US006038833A

United States Patent [19]

Beringer

[11] Patent Number: 6,038,833

[45] Date of Patent: Mar. 21, 2000

[54] BOTTLE GUIDE AND FILL SEAL STRUCTURE FOR BOTTLE FILLING MACHINE

[76] Inventor: Bernie Beringer, 594 Buckingham Rd., Gray, Ind. 37615

[21] Appl. No.: 09/135,107

[22] Filed: Aug. 17, 1998

[51] Int. Cl.[7] ..... B65B 3/04; B65B 39/02; B67C 3/26

[52] U.S. Cl. ..... 53/253; 53/272; 53/273; 53/284.6; 141/368; 141/371

[58] Field of Search ..... 53/273, 272, 271, 53/280, 279, 284.6, 284.5, 282, 281, 253, 250, 473; 141/368, 371, 372, 369, 370

[56] References Cited

U.S. PATENT DOCUMENTS

| | | | |
|---|---|---|---|
| 1,953,642 | 4/1934 | Calleson | 53/272 |
| 2,184,493 | 12/1939 | Gladfelter | 53/279 |
| 3,491,803 | 1/1970 | Galik | 141/368 X |
| 3,587,677 | 6/1971 | King | 141/167 |
| 4,335,761 | 6/1982 | Peronek | 141/371 |
| 4,467,846 | 8/1984 | Croser | 141/47 |
| 4,653,249 | 3/1987 | Simonazzi | 53/272 X |
| 5,063,978 | 11/1991 | Walusiak | 141/263 |
| 5,501,253 | 3/1996 | Weiss | 141/40 |

*Primary Examiner*—James F. Coan

[57] ABSTRACT

Fill seal structures having an elastomeric seal element contained in a housing for use with a liquid filling machine for bottles having fill necks, wherein lifting mechanisms are employed to move the bottles upwardly toward sealing faces of fill ports on the fill bowl of the machine, and wherein the seal structures are designed to provide for fluid tight seals between the top open ends of the bottle necks and the sealing faces, wherein the seal element consists of a generally tubular wall providing a fluid flow passage having an outlet end section and a complex inlet end section, the outlet end section being formed to provide a first contact surface for engaging and sealing against the top open neck end of a bottle, the inlet end section having a generally radially inwardly directed flexible hinge segment integral with the wall at a hinge seam, an annular crest on a radially inner portion of the hinge segment and extending and facing generally axially outwardly therefrom, the crest being adapted to bear against the sealing face whereby the hinge segment and crest become rotated downwardly toward a more horizontal plane when the seal element is moved into its operating sealing position against the sealing face, whereby the crest and the first contact surface are adapted to hermetically seal the top open end of the fill neck against the sealing face during filling or the like of the bottle.

23 Claims, 4 Drawing Sheets

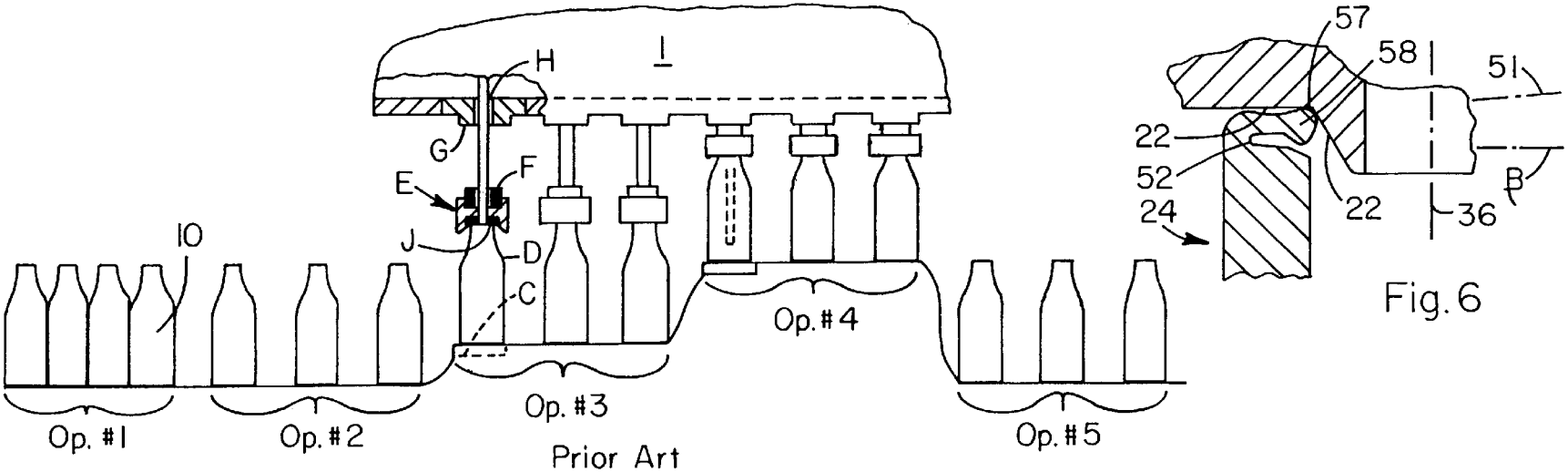
Prior Art
Fig. 2
Fig. 6
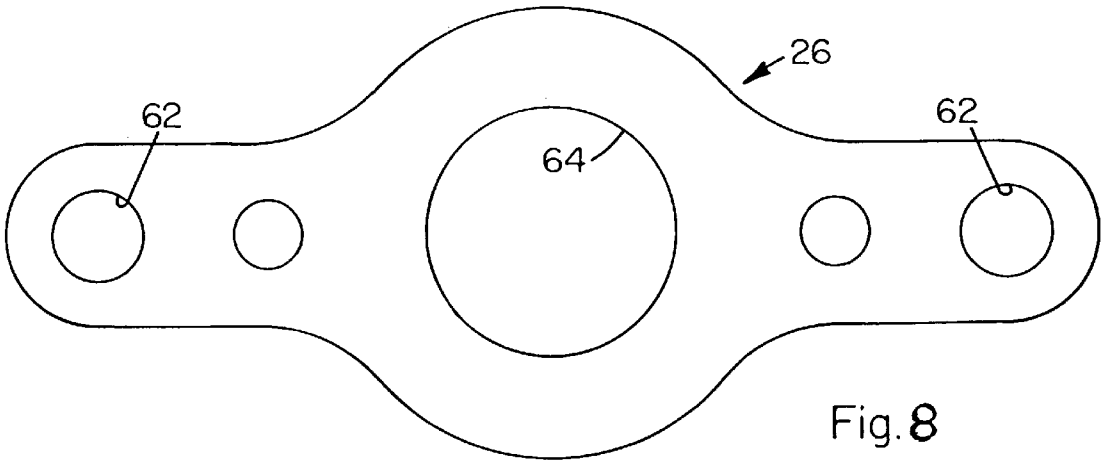
Fig. 8
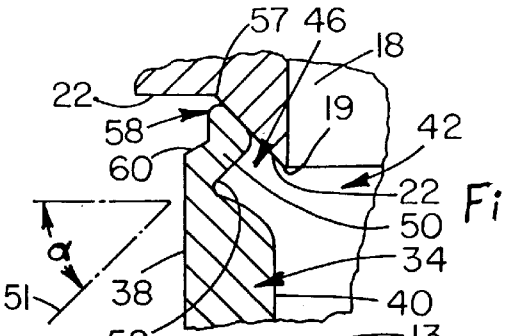
Fig. 5
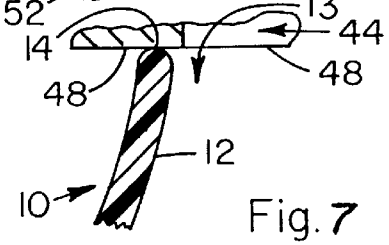
Fig. 7

BOTTLE GUIDE AND FILL SEAL STRUCTURE FOR BOTTLE FILLING MACHINE

BACKGROUND OF THE INVENTION

1. Field

This invention relates to necked container filling machines principally those of the carousel type, and particularly concerns a unique fluid sealing device having unique bottle guide and fill seal means for use on such machines.

2. Prior Art

Conventional fluid filling machines such as are used for filling beer or soft drink bottles typically are constructed to provide multiple filling stations which move along in a continuous conveyor-like manner, e.g., in a circle, and while so moving, progressively perform various operations leading to filling of the bottles. With such machines, conveyor systems are provided for bringing empty bottles to the machines and for removing filled bottles therefrom.

Typical of such filling machines is the carousel type shown and described in detail in the service manual entitled EUROSTAR BOTTLE FILLER, SERVICE MANUAL, Copyright 1980 TECHNAPAC, Inc., The Barry-Wehmiller Company, 318 pages, and particularly on pages 1- 1, 1-2, and 2-1 thru 2-14 thereof, which manual is hereby incorporated herein in its entirety.

For further background information, the progressive operations of such machines as described above, are shown in schematic form in FIGS. 1 and 2 herein marked Prior Art, and with the operations approximately delineated by position and numbered progressively Op. #1–Op. #5. In FIG. 2, the circular or rotational actions of the machine of FIG. 1 are depicted in linear form for clarification.

In these figures Op. #1 brings the bottles 10 to Op. #2 in feed star wheel A which moves the bottles in a circle toward the tangential junction area B of star wheel A and in registry with the moving bottle supports or pads C (only one shown in dotted line) of the rotating carousel. After each bottle is positioned by star wheel A on a support C, the bottle is lifted vertically in Op. #3 by a support cylinder (e.g., air) and the bottle neck top D is engaged, captured and sealed at J by a centering cup E shown in simplistic form. Referring to FIG. 1, elevation of support C in Op. #4A, moves the bottle 10 and cup E upwardly to a point where a seal unit F in the centering cup is pressed against neck top D and a sealing surface G surrounding a fill port H on a filler bowl I on the machine. Typically at this stage (#4B) the air in the bottle is evacuated, and then pressure equalization in the bottle and fill bowl is performed at Op. #4C, and filling of the bottle takes place at Op. #4D. When the filling is completed, the support C is moved downwardly in Op. #5, typically by a cam ramp provided on a non-rotating structure of the machine and engageable with a cam follower on support C. With the bottle now in its retracted position, it is captured in another star wheel J tangentially of the carousel and moved onto further processing operations such as bottle snifting and capping.

It is particularly noted that depending on the type and make of filling machine, the location of the various operations described above may be different, however, the present invention is applicable to any such machine wherein the bottles are lifted into sealing position for evacuation, filling and the like.

In the operation of such filling machines which often process 150 or more glass or plastic bottles at a time, and under $CO_2$ or other gas pressures of for example, 40 to 80 Psig, many leakage or other disaster events, albeit not usually life threatening, are encountered. Such events include explosion or deformation of bottles due to inherent weaknesses in their structures or to excessive gas pressurization, or by improper control of the lift cylinder mechanisms for the bottle supports which causes excessive pressures on the filler seal or the bottle itself, or leakage resulting from inaccurate alignment of the bottle neck, filler seal and fill port.

A further problem encountered with such machines is the lost or down time and labor requirements necessitated by changing over various elements of the machine to accommodate different size bottles, e.g., shorter or taller, as well as different sizes or configurations of the bottle necks. Such problems are exemplified, for example, by the cup seal structures shown in FIGS. 2–10 of the aforesaid service manual publication, and in U.S. Pat. Nos. 5,063,978; 3,491,803; 4,335,761; 5,501,253; and 4,467,846, the disclosures of which are hereby incorporated herein in their entirety, and particularly as regards their disclosures of bottle filling machines which obviously can utilize the present invention.

In these prior machines, the seals are not only dedicated essentially to a single bottle neck size and configuration, but the seals are incorporated into mounting structures on the filling machines in such a manner as to make changeovers difficult, time consuming and expensive. In this regard, where it is necessary to change over such structures, especially on a frequent basis, storage of the different sizes and configurations of the seals, guides, and other structures produces dirty and unsightly areas in the filling room.

OBJECTS OF THE INVENTION

Objects of the present invention are: to provide a fill seal for use on filling machines for bottles or other containers having fill necks, which seal affords improved fluid sealing during filling, greater compression safety margin for the container, and greater leeway for size variations in the container fill necks; to provide such seal in a configuration which allows it to be placed readily on existing filling machines with a minimum of machine modifications; and to provide a carriage means for said seal wherein the carriage means is constructed to easily mount the seal on preexisting or new fill machines.

SUMMARY OF THE INVENTION

These and other objects hereinafter becoming evident have been attained in accordance with the present invention thru the discovery of fill seal structure for use with a liquid filling machine for containers each having a fill neck, wherein a lifting mechanism is employed to move each container upwardly toward a sealing face means of a fill port on the machine, and wherein said seal is designed to provide for a fluid tight seal between the top open end of the container and said sealing face, said seal comprising a generally tubular wall means formed generally around an axial flow axis and having an exterior wall surface and an interior wall surface providing a fluid flow passage, said wall means having an outlet end section and a complex inlet end section, said outlet end section being formed to provide a first contact surface for engaging and sealing against said top open end of a container, said inlet end section having a generally radially inwardly directed flexible hinge segment integral with said wall means at a hinge seam and having a directional axis lying at a relaxed angle "$\alpha$" preferably of from about 10° to about 90° to the horizontal, and most preferably from about 20° to about 70°, an annular crest means on a radially inner portion of said hinge segment and extending and facing generally axially outwardly therefrom, said crest means being adapted to bear against said sealing face means whereby said hinge segment becomes rotated downwardly toward a more horizontal plane such as "β" when said seal is moved into its operating sealing position against said sealing face means, said crest means and said first contact surface being adapted to hermetically seal said top open end of said fill neck against said sealing face means during filling of the container.

Advantageously, the present device as described above performs a double duty as a bottle centering device and a bottle seal with the ability to eliminate costly changeover time along with the ability to properly seal plastic bottles without crushing them. In this regard, the present centering device is itself a unique design. As others are used as neck-through devices none are used as a centering cup and guide assembly for the bottle. The present system provides a number of advantages over the conventional neck support system wherein the changeover between bottle sizes is time consuming and the neck supports need to be stored causing unsightly and dirty areas in the filler room. Such neck supports also can cause misalignment with the filler valve also cause crashes in the "A" frame area if the supports become loose or are installed poorly. With the present device it is impossible to crush a bottle with the pressure cup system when the bowl height is set properly. Also, the cup system allows much more accurate centering on the valve when used in conjunction with the centering mechanism.

BRIEF DESCRIPTION OF THE DRAWINGS

The invention will be further understood from the drawings herein and following description thereof, wherein:

FIGS. 1 and 2 are prior art filling machines as described above;

FIG. 5 is an enlarged cross-sectional view of the related, non-deformed upper wall portion of the present sealing device;

FIG. 6 is an enlarged cross-sectional view of the deformed, sealing mode form of the upper wall portion of the present sealing device;

FIG. 7 is an enlarged view of the bottle neck contact area with the outlet end section of the fill seal wall; and FIG. 8 is a top view of the carriage plate taken along line 8—8 of FIG. 3 in the direction of the arrows.

DETAILED DESCRIPTION OF THE DRAWINGS

Figure 1:
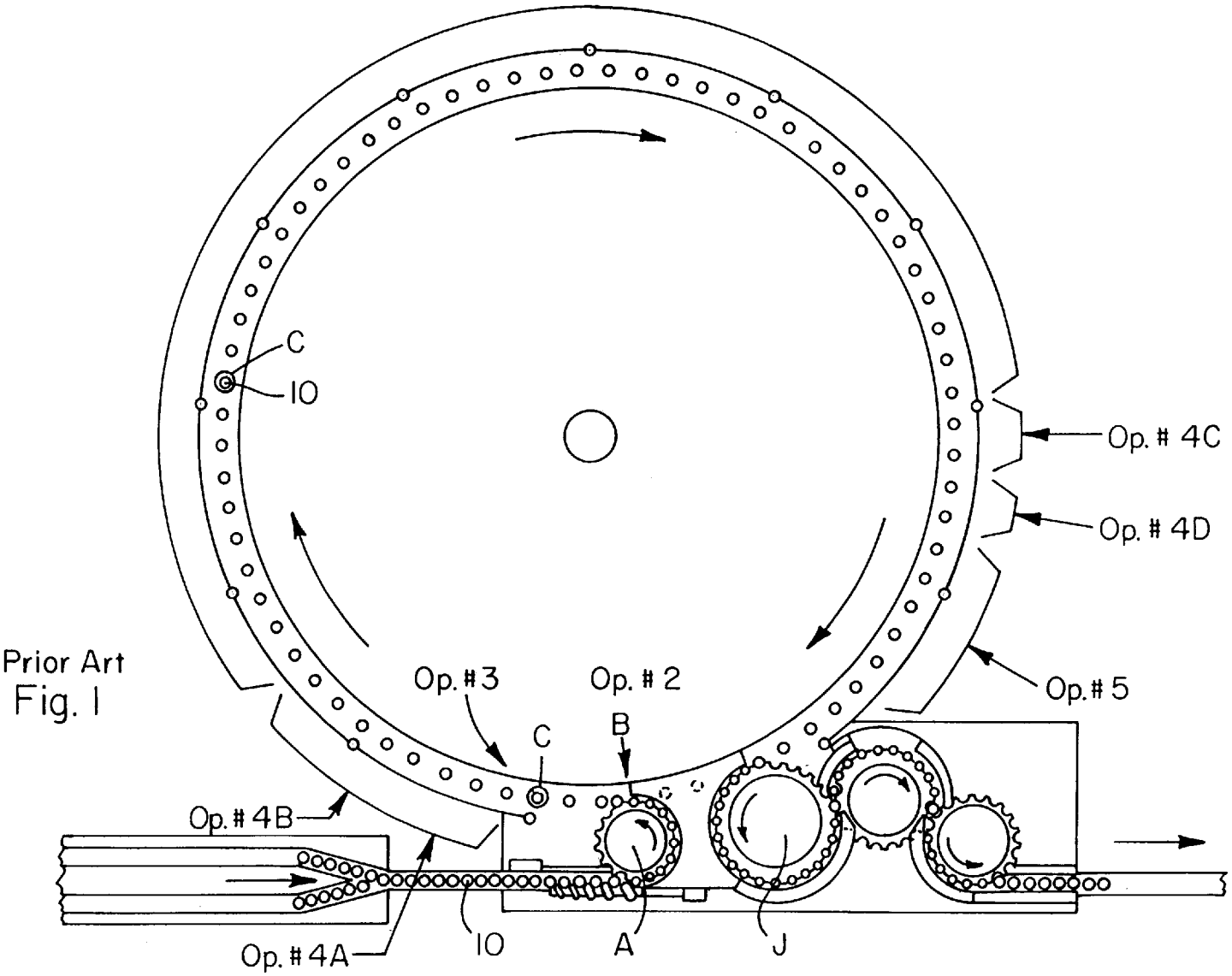
Prior Art Fig. 1
Figure 3:
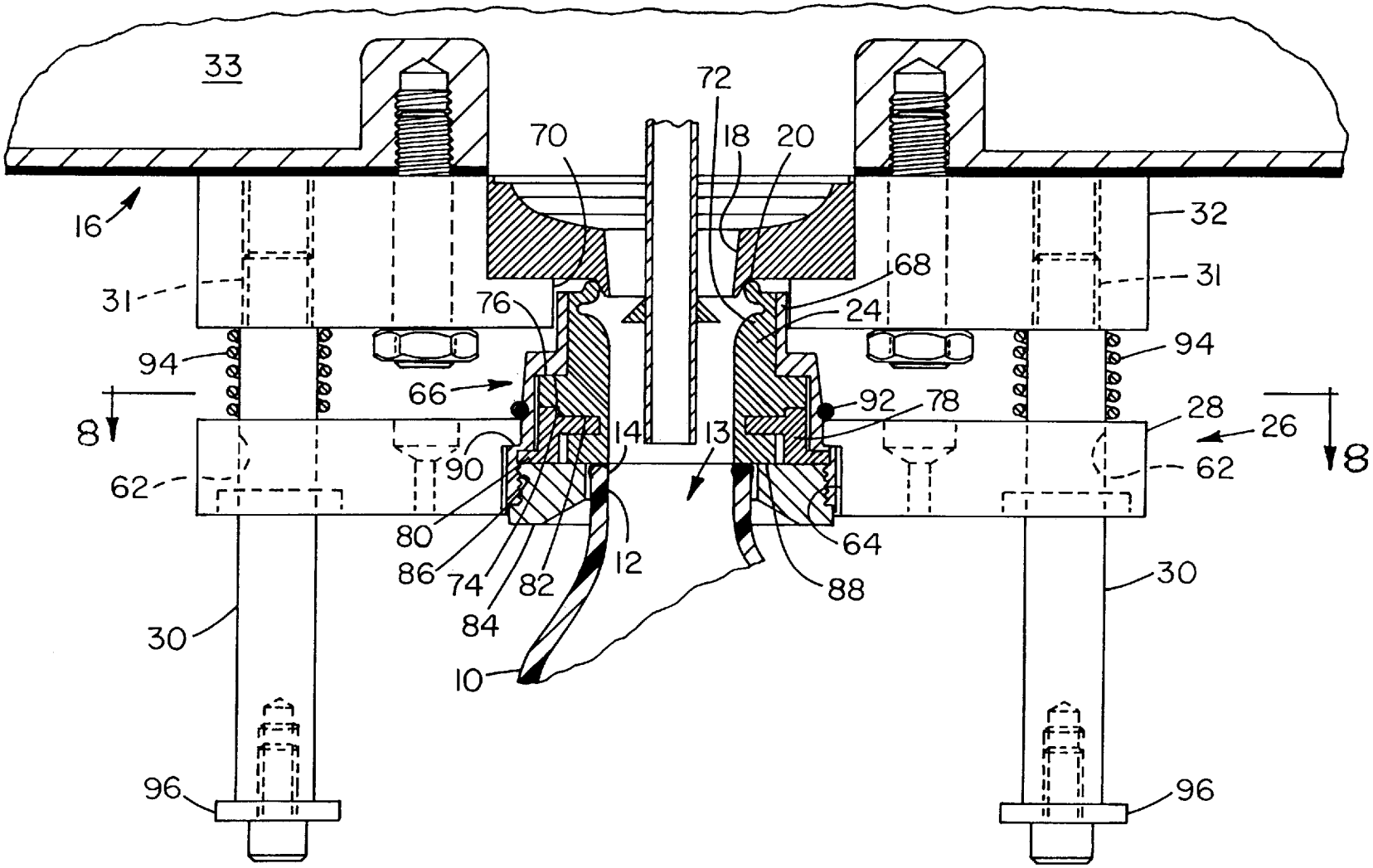
FIG. 3 is side view of the present sealing device in its initial operative sealing position with portions shown in cross-section.
Figure 4:
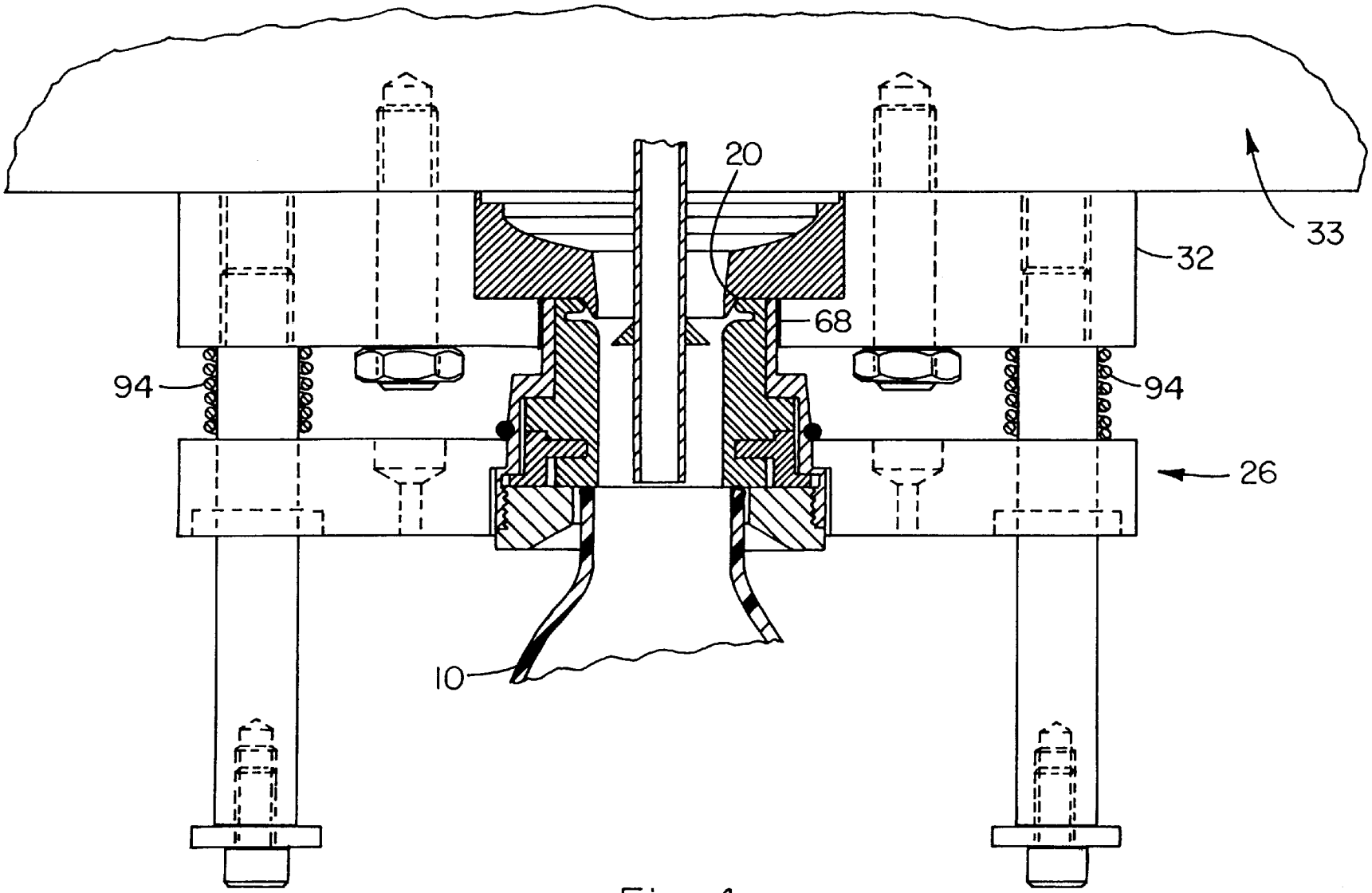
FIG. 4 is a view as in FIG. 3 with the device in its fully operative sealing position.

Referring to the drawings, the present fluid sealing device is used for positioning a container 10 having a fill neck 12 and a fluid inlet 13 thru its open top end 14 in filling position on a container filling machine 16 having a plurality of fill port means 18, whereby the device also provides for a fluid-tight seal 20 between the container inlet 13 and a sealing face means 22 surrounding each fill port means. The sealing device comprises an elastomeric fill seal generally designated 24 mounted on a carriage means generally designated 26. The carriage means comprises one component or plate 28 adapted to slidably interconnect or mount on another component or posts provided on said machine to provide guide means for allowing accurate reciprocable motion of the carriage means toward and away from the fill port means. A port plate 32 is preferably provided and bolted to the bottom of the filler bowl 33 and receives the posts 30 in threaded sockets 31. The fill port means 18 and other components of the filling valves such as the long or short tube of the valve are carried by plate 32 and extend up into the filler bowl generally designated 33 in conventional manner. It is particularly noted that the present invention can be used with any type and design of filler bowl and filler valve, including long or short tube, as long as the fill port structure of the valve provides an annular sealing face means such as 22 as shown, or its equivalent. In this regard, the annular tapered annular outlet ridge 19 of the annular fill port 18, as shown while preferred, is not critical to use of the present seal and the face means 22 can simply be a flat, generally horizontally oriented, annular surface against which the axially outermost annular surface 57 of annular crest means 58 of the present seal is to engage.

The present seal 24 comprises a generally tubular wall means 34 formed generally around an axial flow axis 36 and has an exterior wall surface 38 and an interior wall surface 40 providing a fluid flow passage 42. This wall has an outlet end section 44 and a complex inlet end section 46, the outlet end section being formed to provide a first annular contact surface 48 for engaging and sealing against the top open neck end 14 of the container. The inlet end section has an annular generally radially inwardly directed, flexible hinge segment 50 integral with wall means 34 by a hinge seam 52 and having a directional axis 51 lying at a relaxed angle "α" to the horizontal plane "β".

Segment 50 is adapted to be rotated downwardly by pressure contact with annular sealing face means 22 to a more horizontal plane closer to as "β" (see FIG. 6) when the device is positioned in operating sealing position. An annular crest means 58 on a radially inner portion of the hinge segment and extending and facing generally axially outwardly therefrom is adapted to bear against sealing face means 22 and actually forms the seal.

It is particularly noted that crest means 22 and hinge segment 50 become compressed and deformed downwardly when moved into the sealing position as shown in FIG. 6. Thus the seal provides a hermetic seal as well as providing a measure of leeway to inopportune override of the lift cylinders, which override could otherwise crush the container sufficiently to cause leakage. Therefore, the seal preferably has certain deformation properties which are dependent on the mass, structural configuration and chemical constituency of the seal, and are measured as hinge resistance "HR".

This "HR" valve incorporates the combined resistance's of the hinge segment 50, crest 58 and hinge seam 52 to downward rotation thereof to their positions exemplified in FIG. 6. The "HR" is determined at 70° F. by:

(A) placing the seal, crest down, on a smooth, flat horizontal sheet of glass, e.g., a glass table top, in an area covered with a fresh thin film of 3-IN-ONE® oil;

(B) progressively adding weights, evenly distributed, on top of the first contact surface 48 of the upstanding seal outlet end section;

(C) observing the progressive planar depression of said crest until the plane thereof just reaches the plane of the exterior annular edge 60 of the hinge segment; and (D) ascertaining at that point the cumulative weight placed on said contact surface. This cumulative weight, in pounds divided by the crest circumference, is the "HR" and preferably is within the range of from about 2.0 to about 6.0 lbs., per inch of crest circumference, and most preferably from about 2.75 to about 4.75 lbs., per inch of crest circumference. For example, for a seal having a crest circumference of 3.33 inches as measured on the topmost surface thereof, and comprised of carboxylated nitrile polymer, the "HR" was determined to be 3.75 lbs./in.

The chemical constituency of the elastomeric material of the seal can, of course, be widely varied and may be of natural rubber, polyisoprene, butyl rubber, polyolefin, butadiene, nitrylic polymers, neoprene, Carboxylated Nitrile, various copolymers such as styrene- butadiene, ethylene-propylene copolymers, plasticized polyesters, polyamides, poly(amide-imides), and polytetrafluoroethylene, or the like which are well known to the seal art, and blend compositions thereof which can readily be tailored to meet the "HR" range stated above.

A particularly useful seal composition employs a "Carbox-Nitrile" polymer. This composition is provided by Burton Rubber Pocessing, Inc. of 14330 Kinsuran Road, Burton, Ohio and is characterized as follows:

| PROPERTIES | SPECIFICATIONS AND CONDITIONS | TEST RESULTS AND CONDITIONS |
|---|---|---|
| Cured 15 @350° F. | | |
| Mooney, ML 1 + 4 @250° F. | | 33 |
| Mooney, Scorch, $t_s$ 250° F. | | |
| Durometer, Shore A | 70–80 | |
| Tensile, psi | | 2680 |
| Elongation, % | | 270 |
| 100/200% Modulus, psi | | 1165/2170 |
| Specific Gravity | | 1.18 |
| Color | Black | Black |

Referring to FIG. 7, the carriage plate 26 of metal or plastic, e.g., Delrin®, is provided with bearings 62 for slidably receiving posts 30 with fairly close tolerance, e.g., from about 0.002 to about 0.008 in., total on the diameter, being preferred, such that movement up and down of the plate will be reasonably precise with little side-to-side movement.

A generally centrally located circular opening 64 is provided in the plate for receiving the seal 24 and its housing generally designated 66. It is noted that all components or segments or sections of the seal and housing are annular as viewed in an axial direction, and all components of the housing are of metal such as stainless steel or structural, rigid plastic, or combinations thereof.

The housing 66 is formed with an annular neck portion 68 which is dimensioned to easily slide up into a circular opening 70 in port plate 32. The upper portion 72 of the seal is dimensioned to slide up into portion 68 with close tolerances such that the crest and hinge portion of the seal will become compressed and deformed as the seal is made as shown in FIG. 6.

Shoulders 74 on the housing and 76 on the seal wall engage each other and precisely position the seal within the housing and the crest 58 beyond the housing neck portion 68. In this regard, the maximum extent of downward deformation of the seal crest and hinge segment will be limited by the distance between the bottom of the fill port means 18 and the top of the neck portion 68 and it is preferred that this distance be sufficient to allow full distortion of the seal crest and hinge as shown in FIG. 6.

A pair of semi-circular grommet or retainer inserts 78 and 80 fit into opposite sides of an annular groove 82 in the seal wall and are compressed against the wall at the top of the groove to force the seal against shoulder 74 of the housing when an annular nut 84, which also provides a bottle neck centering cup, is screwed into the treaded socket portion 86 of the housing and forces the grommet inserts upwardly while sealing itself against the compressible annular shoulder 88 of the seal.

The housing is locked into opening 64 by annular shoulder 90 and an O-ring 92 firmly set in an annular groove in the outer surface of the housing. This structure of housing, seal, grommet inserts and nut insure non-leaking of the seal during the filling operation.

Light compression springs 94 on posts 30 insure that the carriage plate 28 returns to its down position after the bottle support is cammed downwardly against stops 96 from the filling position.

The invention has been described in detail with particular reference to preferred embodiments thereof, but it will be understood that variations and modifications will be effected with the spirit and scope of the invention.

I claim:

1. A fluid sealing device for positioning a container having a fill neck and a fluid inlet thru its top, in filling position on a container filling machine having a plurality of fill port means, whereby said device also provides for a fluid tight seal between said inlet and a sealing face surrounding each said port means, said device comprising an elastomeric fill seal mounted on a carriage means, said carriage means having one component of a guide means adapted to slidably interconnect with another component of said guide means provided on said machine for allowing accurate reciprocable motion of said carriage means toward and away from said port means, said seal comprising a generally tubular wall formed generally around an axial flow axis and having an exterior wall surface and an interior wall surface providing a fluid flow passage, said wall having an outlet end section and a complex inlet end section, said outlet end section being formed to provide a first contact surface for engaging and sealing against said neck top, said inlet end section having a generally radially inwardly directed flexible hinge segment integral with said wall by a hinge seam and lying at a relaxed angle "α" of from about 20° to about 70° to the horizontal, an annular crest on a radially inner portion of said hinge segment and extending and facing generally axially upwardly therefrom, said crest being adapted to bear against said sealing face surrounding said port means, and to be rotated downwardly with said hinge segment by pressure contact of said crest with said sealing face to a more horizontal plane when said device is placed in operating sealing position on the machine, said crest and said first contact surface being adapted to hermetically seal said fluid inlet of the container against said sealing face during filling of the container.

2. The device of claim 1 wherein said angle α is from about 35° to about 55°.

3. The device of claim 1 wherein said angle α is from about 40° to about 50°.

4. The device of claim 1 wherein said seal is comprised of polymeric material having approximately the following physical characteristics:

| PROPERTIES | SPECIFICATIONS AND CONDITIONS | TEST RESULTS AND CONDITIONS |
|---|---|---|
| Cured 15 @350° F. | | |
| Mooney, ML 1 + 4 @250° F. | | 33 |
| Mooney, Scorch, $t_s$ 250° F. | | |
| Durometer, Shore A | 70–80 | |
| Tensile, psi | | 2680 |
| Elongation, % | | 270 |
| 100/200% Modulus, psi | | 1165/2170 |
| Specific Gravity | | 1.18 |
| Color | Black | Black |

5. The device of claim 4 wherein said seal is comprised of a carboxylated nitrile polymeric material.

6. The device of claim 1 wherein the HR of said seal is from about 2.75 to about 4.75 lbs./in., of crest circumference.

7. An elastomeric fill seal for use with a liquid filling machine for containers each having a fill neck, wherein a lifting mechanism is employed to move each container upwardly toward a sealing face means of a fill port on the machine, and wherein said seal is designed to provide for a fluid tight seal between the top open end of the container and said sealing face, said seal comprising a generally tubular wall means formed generally around an axial flow axis and having an exterior wall surface and an interior wall surface providing a fluid flow passage, said wall means having an outlet end section and a complex inlet end section, said outlet end section being formed to provide a first contact surface for engaging and sealing against said top open end of a container, said inlet end section having a generally radially inwardly directed flexible hinge segment integral with said wall means at a hinge seam and having a directional axis lying at a relaxed angle "α" of from about 20° to about 70° to the horizontal, an annular crest means on a radially inner portion of said hinge segment and extending and facing generally axially outwardly therefrom, said crest means being adapted to bear against said sealing face means whereby said hinge segment becomes rotated downwardly face to a more horizontal plane when said seal member is moved into its operating sealing position against said sealing face means, said crest means and said first contact surface being adapted to hermetically seal said top open end of said fill neck against said sealing face means during filling of the container.

8. The seal member of claim 7 wherein said angle α is from about 35° to about 55°.

9. The seal member of claim 7 wherein said angle α is from about 40° to about 50°.

10. The seal member of claim 7 wherein said seal is comprised of elastomeric material having the following physical characteristics:

| PROPERTIES | SPECIFICATIONS AND CONDITIONS | TEST RESULTS AND CONDITIONS |
|---|---|---|
| Cured 15 @350° F. | | |
| Mooney, ML 1 + 4 @250° F. | | 33 |
| Mooney, Scorch, $t_s$ 250° F. | | |
| Durometer, Shore A | 70–80 | |

-continued

| PROPERTIES | SPECIFICATIONS AND CONDITIONS | TEST RESULTS AND CONDITIONS |
|---|---|---|
| Tensile, psi | | 2680 |
| Elongation, % | | 270 |
| 100/200% Modulus, psi | | 1165/2170 |
| Specific Gravity | | 1.18 |
| Color | Black | Black |

11. The seal member of claim 10 wherein said seal is comprised of a carboxylated nitrile polymeric material.

12. The seal member of claim 7 having an "HR" of from about 2.75 to about 4.75 lbs./in., of crest circumference.

13. In a bottle filling machine of the carousel type having a plurality of bottle fill ports each of which comprises a sealing face surrounding a fill passage, and wherein a lifting mechanism is provided for lifting each bottle, open top neck end up, toward and away from a fill port, a device for positioning each bottle in filling position on said machine at a fill port whereby said device also provides for a fluid tight seal between the open top neck end of each bottle and a said sealing face, said device comprising a seal unit having a housing in which an elastomeric seal is retained, said unit being mounted on a carriage means, said carriage means having one component of a guide means adapted to slidably interconnect with another component of said guide means provided on said machine for allowing accurate reciprocable motion of said carriage means toward and away from said port means, said elastomeric seal comprising a generally tubular wall formed generally around an axial flow axis and having an exterior wall surface and an interior wall surface providing a fluid flow passage, said wall having an outlet end section and a complex inlet end section, said outlet end section being formed to provide a first contact surface for engaging and sealing against said open top neck end of the container, said inlet end section having a generally radially inwardly directed flexible hinge segment affixed to said wall by a hinge seam and lying at a relaxed angle "α" of from about 20° to about 70° to the horizontal, an annular crest on a radially inner portion of said hinge segment and extending and facing generally axially outwardly therefrom, said crest being adapted to bear against said sealing face, and adapted to be rotated downwardly by pressure contact with said sealing face to a more horizontal plane when said unit is moved into its operating sealing position against said sealing face, said crest and said first contact surface being adapted to hermetically seal said open top neck end against said sealing face during filling of the container.

14. The machine of claim 13 wherein said angle α is from about 35° to about 55°.

15. The machine of claim 13 wherein said angle α is from about 40° to about 50°.

16. The machine of claim 13 wherein said seal is comprised of elastomeric material having the following physical characteristics:

| PROPERTIES | SPECIFICATIONS AND CONDITIONS | TEST RESULTS AND CONDITIONS |
|---|---|---|
| Cured 15 @350° F. | | |
| Mooney, ML 1 + 4 @250° F. | | 33 |
| Mooney, Scorch, $t_s$ 250° F. | | |
| Durometer, Shore A | 70–80 | |
| Tensile, psi | | 2680 |
| Elongation, % | | 270 |
| 100/200% Modulus, psi | | 1165/2170 |
| Specific Gravity | | 1.18 |
| Color | Black | Black |

17. The machine of claim 16 wherein said seal is comprised of a carboxylated nitrile polymeric material.

18. The machine of claim 13 wherein the "HR" is from about 2.0 to about 6.0 lbs./in., of crest circumference.

19. The machine of claim 17 wherein the "HR" is from about 2.75 to about 4.75 lbs./in., of crest circumference.

20. The machine of claim 13 provided with motion restrictor means for limiting the upward travel of said lifting mechanism and preventing excessive depression of said crest.

21. A device for positioning an open top necked container in vertical filling position on a container filling machine having a plurality of fill port means, whereby said device is adapted to seal the open top neck against a sealing surface of a port means, said device comprising a seal unit having an elastomeric seal element mounted in a rigid housing, said seal element having a body wall formed to provide an axial bore, said unit being axially mounted thru an aperture in a horizontally extending carriage plate having spaced ends on either side of said aperture, said ends each having a vertically directed bearing, a pair or guide posts, vertically oriented, and each having connector means at its top end for being affixed to said filling machine in said vertical orientation, each said bearing slidably receiving with close tolerance one each of said guide posts, a stop on the bottom end of each said guide post for limiting downward travel of said carriage plate, said guide posts providing accurate motion to said seal unit toward and away from said port means, said seal element having an annular sealing crest extending upwardly from a radially inner portion of an annular hinge segment integral with said body wall, said hinge segment extending radially inwardly towards said bore, said hinge segment allowing said sealing crest to deform uniformly downwardly and radially inwardly with said hinge segment in response to pressure against said sealing crest by said sealing surface of said port means as said container and seal unit are moved upwardly into filling position.

22. The device of claim 21 wherein said seal element has an "HR" of from about 2.0 to about 6.0 lbs./in., of crest circumference.

23. The device of claim 21 wherein said seal unit is secured in position on said carriage plate by a quick-release O-ring on said hosing and cooperating shoulder means on said housing and carriage plate.

* * * * *